US008740189B2

(12) United States Patent
Klein et al.

(10) Patent No.: US 8,740,189 B2
(45) Date of Patent: Jun. 3, 2014

(54) LIFTING SYSTEM FOR A TRANSPORTATION SYSTEM STRUCTURE

(75) Inventors: Wolfgang Klein, See (AT); Andreas Hein, Vienna (AT); Michael Matheisl, Vienna (AT)

(73) Assignee: Inventio AG, Hergiswil (CH)

( * ) Notice: Subject to any disclaimer, the term of this patent is extended or adjusted under 35 U.S.C. 154(b) by 1972 days.

(21) Appl. No.: 11/635,317

(22) Filed: Dec. 7, 2006

(65) Prior Publication Data

US 2007/0125992 A1 Jun. 7, 2007

(30) Foreign Application Priority Data

Dec. 7, 2005 (EP) ..... 05111810
Apr. 13, 2006 (EP) ..... 06112650

(51) Int. Cl.
*B66F 19/00* (2006.01)

(52) U.S. Cl.
USPC ..... 254/100; 254/134

(58) Field of Classification Search
USPC ..... 254/100, 133 R, 122, 124, 126, 134, 254/93 A, 102, 104; 269/289 MR
See application file for complete search history.

(56) References Cited

U.S. PATENT DOCUMENTS

| | | | | |
|---|---|---|---|---|
| 2,383,225 | A | 8/1945 | Sorensen et al. | |
| 2,733,330 | A * | 1/1956 | Blewett | 219/158 |
| 2,795,934 | A * | 6/1957 | Jenkins | 405/300 |
| 3,724,015 | A | 4/1973 | Japes | |
| 5,161,782 | A * | 11/1992 | Huang | 254/126 |
| 5,272,805 | A | 12/1993 | Akeel et al. | |
| 5,664,762 | A * | 9/1997 | Rothbauer | 254/103 |
| 5,855,360 | A * | 1/1999 | Wurdack | 254/100 |
| 6,988,719 | B2 * | 1/2006 | Ursell et al. | 269/289 MR |
| 7,086,664 | B2 * | 8/2006 | Voegeli et al. | 280/769 |
| 7,207,555 | B2 * | 4/2007 | Valentin et al. | 269/289 MR |
| 7,264,226 | B2 * | 9/2007 | Smith et al. | 254/93 R |
| 7,699,274 | B2 * | 4/2010 | Riibe et al. | 248/55 |
| 2003/0230839 | A1 * | 12/2003 | Ursell et al. | 269/289 MR |
| 2007/0125992 | A1 * | 6/2007 | Klein et al. | 254/88 |

FOREIGN PATENT DOCUMENTS

GB 2352 692 A 2/2001

* cited by examiner

*Primary Examiner* — Lee D Wilson
(74) *Attorney, Agent, or Firm* — Ladas & Parry LLP

(57) ABSTRACT

A lifting system for vertical adjustment of a transportation system structure consists of a foot that is fastened onto the transportation system structure and a foot cradle. The foot is bounded on opposite sides by two foot surfaces that are arranged at a foot-surface angle to each other. The foot cradle has two complimentary supporting surfaces against which the foot surfaces rest. The supporting surfaces are vertically movable, allowing the foot and transportation system structure to be raised or lowered, and the vertical adjustment thereby takes place.

8 Claims, 3 Drawing Sheets

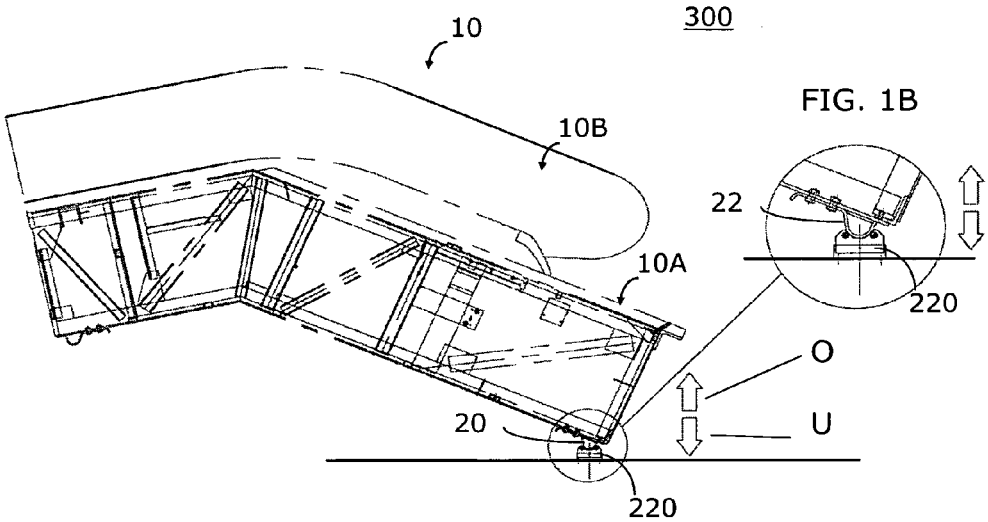
FIG. 1B
FIG. 1A
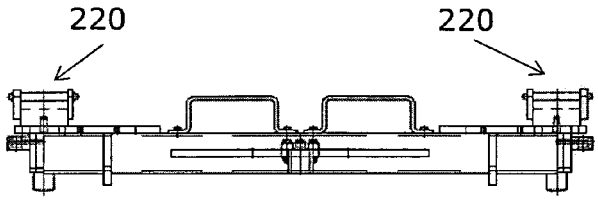
FIG. 2B
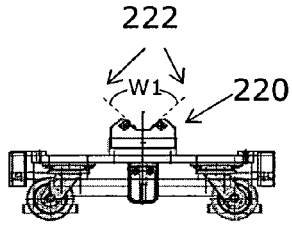
FIG. 2A

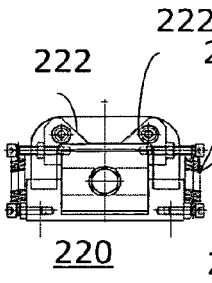
FIG. 3A
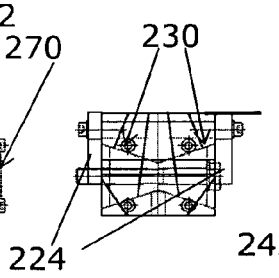
FIG. 3B
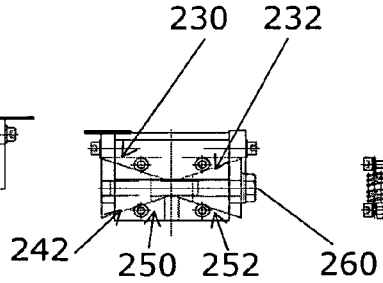
FIG. 3C
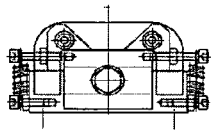
FIG. 3D
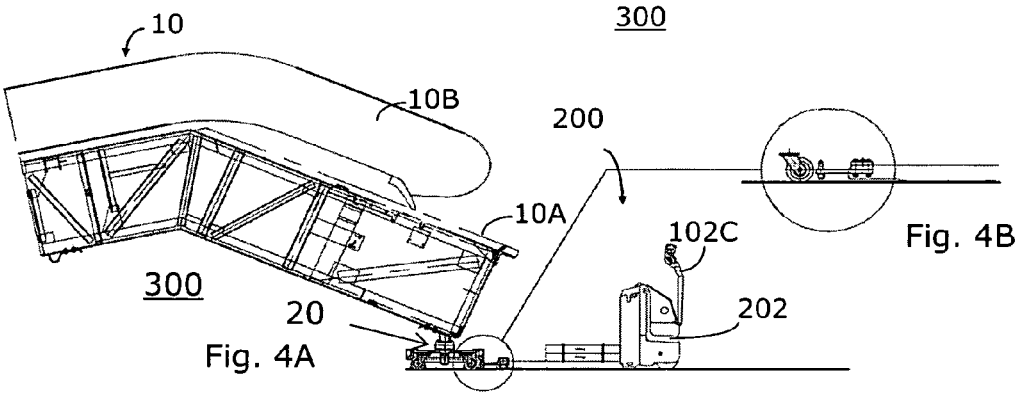
Fig. 4A
Fig. 4B

400

LIFTING SYSTEM FOR A TRANSPORTATION SYSTEM STRUCTURE

The invention relates to a hoisting system for vertical adjustment of a transportation system structure, a transportation system cradle with a lifting system, an intermediate product for manufacturing assembly of a transportation system structure, and an installation location and an installation method for manufacturing assembly of transportation system structures of the intermediate products. "Manufacturing assembly" is defined as the assembly of various individual parts and subassemblies of an escalator or of a moving walk.

BACKGROUND OF THE INVENTION

Lifting systems, within the meaning of the present invention, are used to align transportation system structures in assembly stations with respect to height. The term "transportation system structure" is to be understood as a transportation system, in other words an escalator or moving walk, in an unfinished state during its at-factory manufacturing assembly or a complete assembly, which can be for example, a frame or truss that during manufacturing assembly is fitted with further elements and/or subassemblies or parts.

During manufacturing assembly it can be important for the transportation system structure to be precisely horizontalized or perfectly accurately level.

A lifting system that is usable for height adjustment of the transportation system structure during its manufacturing assembly can, for example, be embodied in such manner as to have several feet, each of which is cradled in a foot-cradle. Each foot rests for support on a supporting surface. To adjust the height, the supporting surface is raised or lowered.

The main problems and concerns of a lifting system include the following:

Firstly, the lifting system must ensure the most perfect possible horizontalization or height adjustment in the range of a few millimeters or centimeters.

Secondly, the transportation system structures are so bulky and heavy that high mechanical demands must be made on the lifting system.

Thirdly, the lifting systems should be rapidly loadable and quick and easy to operate. The at-factory manufacturing assembly of transportation systems can be greatly rationalized if it takes place in an assembly line. Such an assembly line comprises several assembly stations that are passed through in succession by the transportation system structures and loaded at the same time. In each assembly station, during an assembly phase, station-specific assembly steps are executed. On completion of the as-synchronously-as-possible executed assembly phase, during a transport phase the transportation system structures are taken to the respective following assembly stations, and under optimal fabrication conditions the transport of all transportation system structures should also take place as synchronously as possible. It is self-evident that rapid loading and operation of the lifting systems greatly shortens the manipulation times.

Fourthly, the lifting systems should be inexpensive, since a plurality of them, namely several lifting systems for each assembly station, is required.

Although from U.S. Pat. No. 3,724,015 an adjustable stair in the form of a gangway for use at airports is known, it does not relate to a stair in the context of manufacturing assembly. In addition, the required accuracies are significantly less than are required for the manufacturing assembly of transportation systems.

A lifting system with which the aforesaid problems can be solved has heretofore not been known.

Objectives of the invention are therefore to

- create a lifting system that is suitable for use in the manufacturing assembly of transportation system structures;
- propose a transportation system cradle with such a lifting system;
- propose an intermediate product that consists of such a transportation system cradle and a transportation system structure;
- propose an assembly plant for manufacturing assembly onto such an intermediate product or of the transportation system structure of the intermediate product respectively; and
- propose a method of executing such a manufacturing assembly.

BRIEF DESCRIPTION OF THE INVENTION

The foregoing objectives are fulfilled according to the invention of a lifting system in which a transportation system structure has a downwardly-directed foot or positioning piece that is received by a cradle. The foot has at least one surface that rests on a supporting surface of the cradle. The supporting surface is complimentary to the foot surface received. The supporting surface is movable vertically, thus allowing the positioned height of the transportation system to be adjusted.

The transportation system structure and at least one cradle together form an intermediate product in which the transportation structure is firmly supported by the cradle, preventing relative vertical or horizontal movements of the transportation system's structure relative to the cradle, which allows the vertical position of the transportation system structure to be adjusted through the cradle.

An assembly plant for the transportation system in accordance with the invention has a sequence of assembly stations and utilizes cradles to support the transportation system structures being assembled therein. A control system is provided to transfer intermediate products to and between assembly stations. The plant may have a lifting apparatus to place the transportation system on the cradles and remove them from the cradles.

The new lifting system consists of a foot, which at least during the assembly phase is joined rigidly onto the transportation system and during manufacturing assembly faces downward, and a foot cradle in which the foot can be cradled or is cradled in the assembly stations. The foot can be cylindrical, round, spherical, crowned, or prismatic. This foot can, for example, be bounded on opposite sides by two foot surfaces that are arranged relative to each other at a foot-surface angle. The foot can also be prismatic in a vertical cross section. In this case, the foot cradle has two supporting surfaces against which the foot surfaces rest. These supporting surfaces are formed and arranged complementary to the foot surfaces, namely also prismatic. The supporting surfaces are vertically movable. With movement of the supporting surfaces, the foot changes its absolute vertical position, whereby vertical adjustment of the transportation system takes place.

To avoid lateral displacement when adjusting the height of a vertical foot axis, it is advantageous if the two supporting surfaces are arranged mirror-symmetrically to a vertical central plane and are horizontally displaceable relative to this vertical central plane.

In an advantageous embodiment of the lifting system, the supporting surface forms an upper bounding surface of a wedge element. This wedge element also has a lower bounding surface by which the wedge element is movably supported on a sliding surface of a base body. The lower bounding surface of the wedge body is preferably at a wedge angle to a horizontal plane such that the upper bounding surface and the lower bounding surface of the wedge body are mirror-symmetrically aligned to a horizontal plane.

For the purpose of moving the supporting surfaces and wedge body, the lifting system can have a mechanical arrangement, in particular a screw arrangement. The screw arrangement can, for example, have a central screw that can be actuatable or driven by means of an open-end wrench, a ring wrench, or socket wrench, or an electrically or hydraulically or pneumatically actuatable wrench. The lifting system also can have a spring arrangement to pre-stress the supporting surfaces of the foot cradle on the foot and to facilitate actuation of the lifting system.

To hold the foot securely in the foot cradle, the foot cradle can have two vertical side plates that face each other and together with the supporting surfaces bound a space for the foot.

The lifting system normally has additional feet and foot cradles, in total for example, three or four feet and foot cradles.

BRIEF DESCRIPTION OF THE DRAWINGS

Further details and advantages of the invention are described below in relation to an illustrative embodiment and with reference to the drawings, wherein:

FIG. 1A is a side elevation view of an intermediate product, consisting of a stationary lifting system with an area of an escalator that is supported on it;

FIG. 1B is an enlarged view of the area that is circled in FIG. 1A;

FIG. 2A is a side elevation view of a transportation system cradle with two lifting systems, of which only one is visible, the lifting system being arranged on a mobile cradle unit of the transportation system cradle;

FIG. 2B is a front view of the lifting systems that are fastened onto the cradle unit of the transportation system cradle;

FIG. 3A is a front view of a lifting system according to the invention in an upper position;

FIG. 3B is a side view of the lifting system shown in FIG. 3A in the upper position;

FIG. 3C is a side view of the lifting system shown in FIGS. 3A and 3B in a lower position;

FIG. 3D is a front view of the lifting system shown in FIGS. 3A to 3C in the lower position;

FIG. 4A is a side elevation view of an intermediate product according to the invention;

FIG. 4B is an enlarged view of the area that is circled in FIG. 4A; and

DETAILED DESCRIPTION OF THE INVENTION

Figure 5:
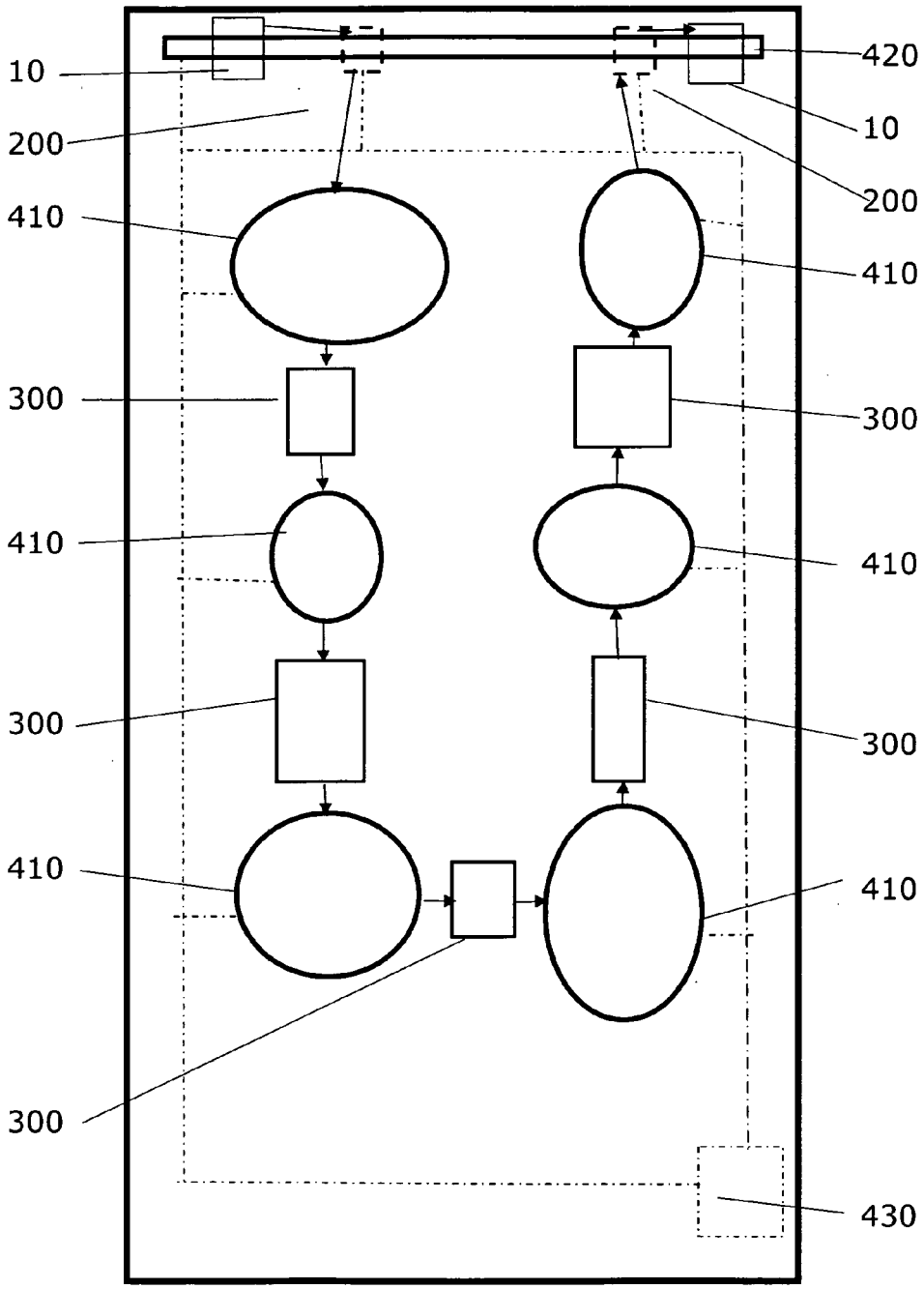
FIG. 5 is an assembly plant according to the invention.

FIGS. 1A and 1B show a transportation system structure 10, namely a truss 10A of a still unfinished escalator with a balustrade 10B. The transportation system structure 10 has a downward pointing foot or transport foot 20 that that is cradled in a foot cradle 220. The foot 20 and the foot cradle 220 essentially form a lifting system 20/220 according to the invention. The foot 20, and along with it the adjoining area of the transportation system structure 10, can be moved upwards and downwards relative to the foot cradle 220 in the direction of the arrows O and U.

While the lifting system 20/220 that is shown in FIGS. 1A and 1B is stationary and can be, for example, at a generally shown assembly station 410 of an assembly plant 400, FIGS. 2A and 2B show two essentially identical lifting systems 20/220 which as a pair in FIG. 2B (left and right) are arranged on a mobile cradle unit of a transportation system cradle unit or of a transportation system cradle 200.

The foot 20 that is shown only in FIGS. 1A and B is executed wedge-shaped or round and has two foot surfaces 22 that face each other and taper towards the bottom that together enclose a foot angle W1. These tapering foot surfaces 22 are connected by two further parallel vertical foot surfaces. The foot can be cylindrical, round, spherical, crowned, or prismatic.

The space for the foot 20 is laterally bounded by the cradle supporting surfaces 222 that stand opposite each other and, according to FIGS. 3A and 3D, by cradle side plates 224 that stand opposite each other and are arranged between the supporting surfaces 222. The sloping foot surfaces 22 rest against the supporting surfaces 222 and one of the vertical foot surfaces rests against a side plate 224 as long as the foot 20 is cradled in the foot cradle 220.

By means of the sloping arrangement of the supporting surfaces 222, lowering of the foot 20 into the foot cradle 220 is facilitated, so that the supporting surfaces 222 exert a centering effect.

FIGS. 3A to 3D show details of the foot cradle 220 of the lifting system 20/220. In particular, FIGS. 3B and 3C show two wedge bodies 232 that are arranged symmetrically relative to a vertical central plane. Each of the wedge bodies 232 has a wedge surface 230 as an upper bounding surface. The complementarily formed or round, crowned, bomb-shaped, or barrel-shaped and arranged foot surfaces 22 of the foot 20 come to rest on the supporting surfaces 222. The supporting surfaces 222 enclose the angle W1. This angle W1 can also be embraced by the foot surfaces 22. The wedge bodies 232 are formed and arranged symmetrically to a horizontal plane. They have an upper bounding surface or wedge surface 230 and they have a lower bounding surface 242. The wedge bodies 232 rest on sliding surfaces 252 of a base element 250. The sliding surfaces 252 are complementary, in other words arranged with the same angle of slope to a horizontal plane as the lower bounding surfaces 242.

A screw device 260, or in the present case a single central screw, serves to move the wedge bodies 232 and with them the wedge surfaces 230 horizontally. The wedge surfaces 230 thereby retain their symmetrical arrangement relative to the vertical central plane so that no lateral movement of the foot 20 and with it the transportation system structure 10 takes place.

On tightening the screw device 260, the wedge bodies 232 approach each other and the wedge surface 230 slides outward, on which the downward tapering foot surfaces 22 execute relative to each other a resting movement, or no movement, on the supporting surfaces 222, whereby the foot 20 and thereby the transportation system structure 10 is raised. Correspondingly, the lower bounding surfaces 242 and the sliding surfaces 252 of the base element 250 execute a sliding relative movement. On slackening the screw device 260, the reverse sliding movements take place, in other words the wedge bodies 232 move away from each other and the foot 20 lowers itself downwards.

Tension springs 270 are arranged at the sides and serve to exert an even pretensioning of the arrangement with the wedge bodies 232. In addition, the tension springs 270 facilitate the downward slide of the wedge bodies 232 onto the base element 250.

Both wedge surfaces 230 must be made of an especially sliding-friendly material, brass or bronze, for example, or other coated materials with similar properties having proven themselves suitable materials for the wedge bodies 232.

The surfaces that slide against each other must normally be lubricated with a suitable lubricant such as lubricating grease or lubricating oil.

FIGS. 4A and 4B show an intermediate product 300 supported by a transportation system cradle and a transportation system structure according to the invention.

FIG. 5 shows an assembly plant 400 according to the invention, the method according to the invention, being apparent. The assembly plant 400 is shown during a transfer phase. The assembly plant 400 consists of several assembly stations 410 which are designed to execute different station-specific assembly steps, it being possible for each assembly step to comprise part-steps. Also belonging to an assembly station 410 is a plurality of transportation system cradles 200 and a control system 430 that fully or partly automatically controls the processes in the assembly station 400. A hoisting device 420, for example a gantry crane or bridge crane, serves to lower the transportation system structures 10 into the transportation system cradles 200 and remove them again from the transportation system cradles. Further lifting devices are not necessary, so the assembly plant does not need any elaborate building structures.

A first transportation system cradle 200 shown at top left of FIG. 5, is provided to cradle a first transportation system structure 10. Further transportation system cradles 200 have already cradled other transportation system structures 10 and, together with these, form intermediate products 300. During the transfer phases, the intermediate products 300 are transported by means of the autonomously movable transportation system cradles 200 in the direction of the arrows to the individual assembly stations 410 or moved out of them respectively. The intermediate products 300 can be transferred both in their lengthwise direction and perpendicular to that direction, as between the assembly stations shown at the bottom of FIG. 5. During the assembly phases, the intermediate products 300 are stationary in the assembly stations 410. On conclusion of the complete assembly, the transportation system structure 200 is removed from the respective completely processed intermediate product 300, which can be done with the aid of the already mentioned hoisting device, as shown at the top right of FIG. 5. The control system 430, indicated symbolically by chain-dotted lines, serves to control the overall process of the complete assembly. The control system 430 can also include only parts of the assembly plant, for example one, or several, or not all, assembly stations.

We claim:

1. A lifting system for vertical adjustment of a transportation system structure in the form of an escalator or moving walk, comprising:

a foot mounted to the transportation system that points downwardly during assembly of the transportation system structure, the foot having a surface at an acute angle extending with respect to a horizontal; and a foot cradle unit for engagement with the foot to support the transportation system structure;

the foot cradle unit having a foot cradle, a wedge element, and a base, the foot cradle having a top supporting surface at a mirror-symmetric acute angle to the foot surface arranged for complementary engagement with the foot surface and a lower surface at an acute angle to the horizontal;

the base having a top surface at a wedge angle to the horizontal;

the wedge element having an lower bounding surface at an angle complementary to the wedge angle and movably supported upon the base top surface and an upper bounding surface at an angle complementary to the angle of the foot cradle lower surface and movably supporting the foot cradle, the upper and lower bounding surfaces being arranged mirror-symmetrically to the horizontal;

the foot cradle lower surface resting on upon the upper bounding surface, the wedge element being movable horizontally upon the base top surface such that the foot cradle lower surface moves vertically whereby the transportation system structure thereby changes its positional height and the vertical adjustment thereby takes place.

2. The lifting system according to claim 1, wherein the foot has two complementary surfaces arranged mirror-symmetrically to a vertical central plane and the foot cradle has two supporting surfaces arranged mirror-symmetrically to the foot surfaces and to the vertical central plane and two wedge elements with upper and lower bounding surfaces.

3. The lifting system according to claim 1, further comprising a screw arrangement by means of which the wedge element is horizontally movable.

4. The lifting system according to claim 1, further comprising a spring arrangement for pretension of the supporting surface of the foot cradle in a vertical direction.

5. The lifting system according to claim 1, wherein the foot cradle has two side plates lying opposite to each other that, together with the olTe supporting surface, bound a space for the foot.

6. The lifting system according to claim 1, characterized in that the foot is so formed and arranged to be cradled by a foot cradle of a cradle unit of a transportation system cradle so as to serve as a transport foot.

7. The lifting system according to claim 1, characterized in that the lifting system has from 1 to 4 feet and foot cradles tmi_ts.

8. The lifting system according to claim 3, wherein the screw arrangement has a central screw that is actuatable by wrench means.

* * * * *